US005404934A

United States Patent [19]

Carlson et al.

[11] Patent Number: 5,404,934

[45] Date of Patent: Apr. 11, 1995

[54] RETROFIT AIR CONDITIONING SYSTEM

[75] Inventors: Allan G. Carlson; Timothy G. Huene, both of Carmel, Ind.

[73] Assignee: Currise & Carlson, Inc., Carmel, Ind.

[21] Appl. No.: 885,941

[22] Filed: May 19, 1992

[51] Int. Cl.[6] ..... F28F 3/00

[52] U.S. Cl. ..... 165/22; 165/16; 165/50; 165/123; 236/49.3; 454/269; 454/258

[58] Field of Search ..... 165/22, 50, 122, 123, 165/108, 16; 236/49.3, 13; 454/256, 258, 269

[56] References Cited

U.S. PATENT DOCUMENTS

| | | | |
|---|---|---|---|
| 3,041,047 | 6/1962 | Ashley et al. | 163/50 |
| 3,172,463 | 3/1965 | Bowman | 165/123 X |
| 3,212,424 | 10/1965 | Davis | 454/269 X |
| 3,464,487 | 9/1969 | Gold | 236/13 X |
| 3,720,258 | 3/1973 | Chandler | 454/269 X |
| 3,744,556 | 7/1973 | Church | 165/123 X |
| 3,777,806 | 12/1973 | Tailor | 165/50 X |
| 3,833,057 | 9/1974 | Doherty | 165/22 X |
| 3,841,392 | 10/1974 | Osheroff | 165/22 |
| 3,951,205 | 4/1976 | Zilbermann | 165/22 X |
| 4,203,485 | 5/1980 | Zilbermann et al. | 236/13 |
| 4,347,712 | 9/1982 | Benton et al. | 236/49.3 X |
| 4,537,035 | 8/1985 | Stiles | 165/16 X |
| 4,545,524 | 10/1985 | Zelczer | 165/22 X |
| 4,607,497 | 8/1986 | Ferdows et al. | 165/16 X |
| 4,711,394 | 12/1987 | Samuel | 165/22 X |
| 4,942,921 | 7/1990 | Haessig et al. | 236/49.3 X |

*Primary Examiner*—John Rivell
*Attorney, Agent, or Firm*—Woodard, Emhardt, Naughton, Moriarty & McNett

[57] ABSTRACT

A retrofit air conditioning system for use with an existing induction air conditioning system is disclosed, wherein the existing system includes a central fan unit supplying air to a plurality of distribution units in corresponding rooms. The retrofit air conditioning system includes a retrofit air conditioning unit sized for receipt in an existing distribution unit. The retrofit air conditioning unit includes a fan downstream of an adjustable damper for inducing conditioned air from the central fan unit and for inducing recirculated air from the room. A microcontroller receives a temperature signal from a thermostat and produces a damper signal to adjust the damper in accordance with the sensed temperature. Also disclosed is a retrofit central fan unit for use with the retrofit induction unit, wherein the retrofit central fan unit supplies varying amounts of conditioned air to the distribution units to maintain a constant supply pressure.

21 Claims, 7 Drawing Sheets

RETROFIT AIR CONDITIONING SYSTEM

BACKGROUND OF THE INVENTION

The present invention relates generally to air conditioning systems and, more specifically, to a retrofit air conditioning system for use with an existing induction air conditioning system.

Currently, many older commercial and educational buildings employ an induction air conditioning system which supplies a mixture of fresh ventilation air and recirculated building air to individual rooms of the building. Typically, these systems provide means for heating the air, either centrally and/or locally, to provide conditioned air and, in some instances, have been modified to include means for cooling the air as well. Because the design for these induction systems dates back over 30 years, these systems do not meet the performance and efficiency requirements of today's new, more sophisticated air conditioning systems. A need therefore exists for a means to bring the performance and efficiency of these older, less efficient air conditioning systems up to current operating levels.

Solutions for improving existing induction systems have focused primarily on replacing a majority of the existing system with a new, more sophisticated air conditioning system and, as a result, have been costly. Because variable operating cost savings of a new system over an existing system do not quickly recover the initial cost, upgrading of existing systems has typically not been found to be cost-justified. This is particularly true for those existing induction systems employed in schools in Indiana where new systems have not been cost-effective due in part to the problems associated with modifying the existing building construction, such as the removal of asbestos and other additional system components.

Nevertheless, these existing induction systems do not meet the needs of today's schools. For example, to accommodate more students with minimal added expense, some school systems have adopted a twelve-month operating year employing staggered semesters. As such, both cooling and heating of air supplied to the individual school rooms is desired, and preferably, at minimal added expense.

One example of an existing induction system, employed in more than 300 Indiana schools, employs heating means for providing 70° F. air to each room, wherein the conditioned 70° F. air induces recirculation air from the room to supply a mixture of conditioned air and recirculated air into the room. Some of these existing systems, rather than being replaced, have been modified to cool the recirculated room air prior to mixing with the conditioned air. However, these modified systems are inefficient and represent significant operating cost increases for the school. Furthermore, the added restriction of cooling coils in the recirculated room air's path adversely affects the optimum balance of conditioned and recirculated air delivered to the room.

A need therefore exists for an improved air conditioning system adapted for replacing an existing induction air conditioning system. Such a system should provide both efficient cooling and heating of air to provide year-round comfort. Such a system should be compatible with an existing induction system to reduce the cost of implementation. Ideally, such a system would be a retrofit air conditioning system which utilizes as much of the existing induction system hardware as possible.

Such a system should also be uniquely compatible with existing induction air conditioning systems currently installed in many school buildings to further reduce the cost of implementation.

SUMMARY OF THE INVENTION

A retrofit air conditioning system is disclosed for use with an existing induction air conditioning system, wherein the existing system includes a distribution unit having an induction unit contained within an enclosure. The retrofit air conditioning system includes a retrofit induction unit sized for receipt in the existing distribution unit, wherein the retrofit induction unit is received in the existing enclosure and replaces the existing induction unit.

The retrofit induction unit further includes means for receiving conditioned air from a duct, means for adjusting the amount of conditioned air received from the duct in response to a first signal, means for receiving recirculated air from a space, fan means for inducing conditioned air from the duct and inducing recirculated air from the space wherein the fan means exhausts a mixture of conditioned air and recirculated air, means for sensing temperature in the space and producing a temperature signal, and controller means for receiving the temperature signal and producing a first signal in accordance with the sensed temperature.

In the preferred embodiment, the retrofit air conditioning unit also replaces an existing heating unit contained in the existing enclosure. As such, the retrofit induction unit further includes means for heating the mixture of conditioned air and recirculated air in response to a second signal, and the controller means includes means for producing a second signal in accordance with the sensed temperature.

One object of the present invention is to provide an improved air conditioning system adapted for replacing an existing induction air conditioning system.

Another object of the present invention is to provide an air conditioning system which provides both efficient cooling and heating of air for year-round comfort.

Another object of the present invention is to provide an air conditioning system compatible with an existing induction system to reduce the cost of implementation.

Another object of the present invention is to provide a retrofit air conditioning system which utilizes as much of the existing induction system hardware as possible.

Another object of the present invention is to provide a retrofit air conditioning system which is uniquely compatible with existing induction air conditioning systems currently installed in many school buildings.

DESCRIPTION OF THE PREFERRED EMBODIMENT

Figure 1:
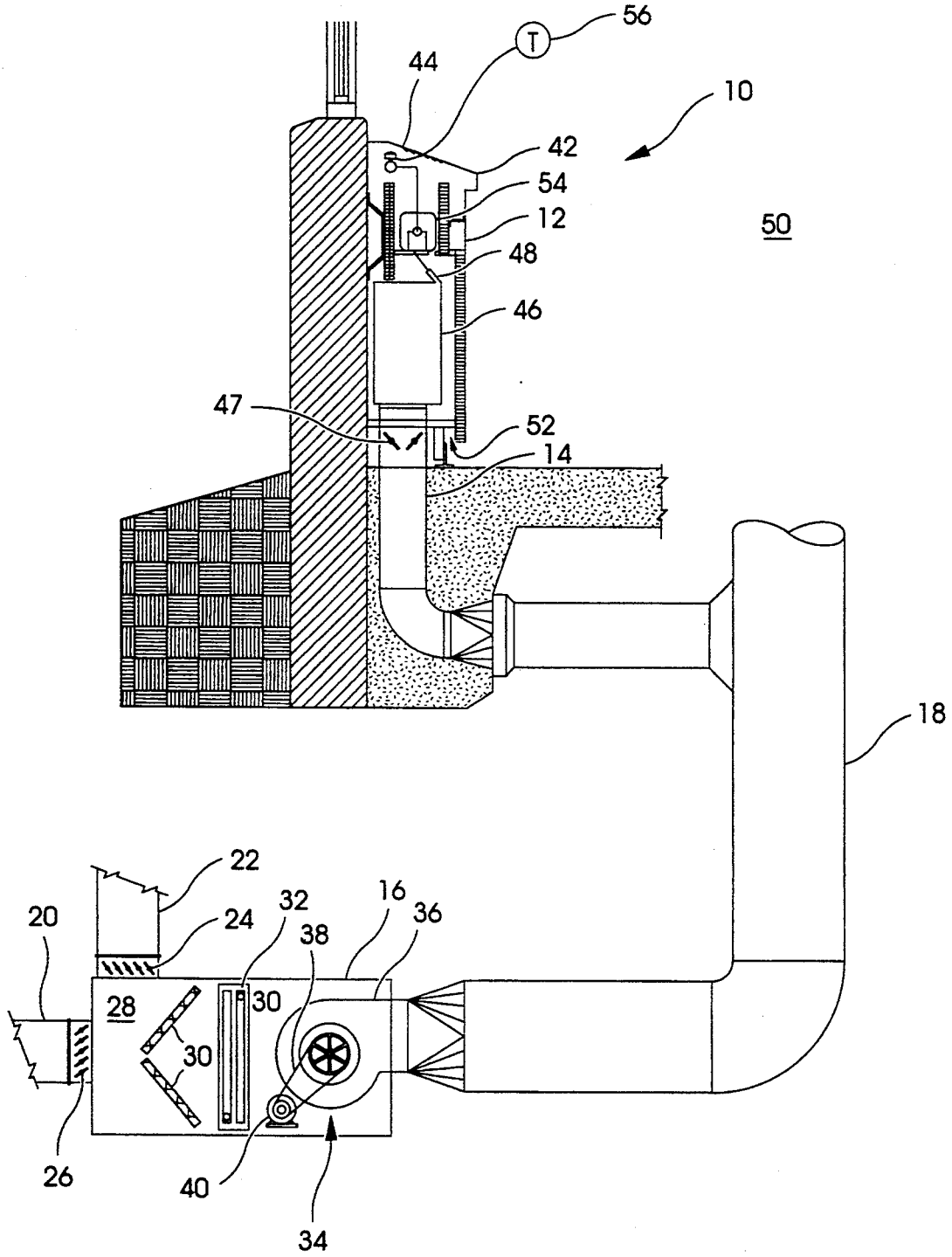
Fig. 1 (PRIOR ART)
FIG. 1 is a side partial cross-sectional view of an existing induction air conditioning system including a distribution unit receiving conditioned air from a primary air duct.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
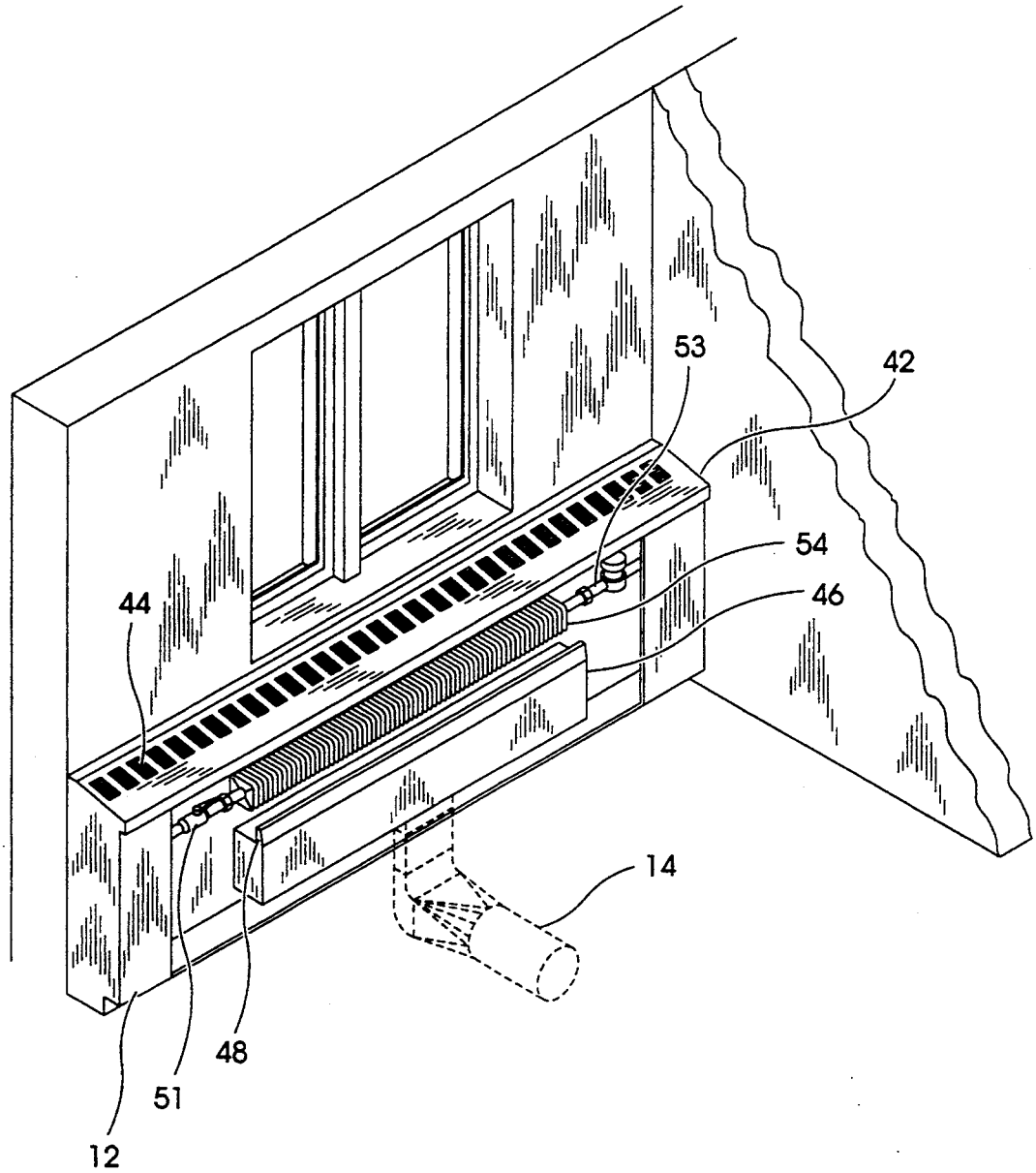
Fig. 2 (PRIOR ART)
FIG. 2 is a perspective view of an existing heating unit and induction unit contained within an existing enclosure of the distribution unit of FIG. 1.

Before describing the retrofit air conditioning system, an understanding of the existing induction air conditioning system and its operational characteristics is required. Referring now to FIGS. 1 and 2, a typical existing induction air conditioning system 10 is shown including a distribution unit 12 receiving conditioned air from a primary air duct 14. Primary air duct 14 receives conditioned air from a central air supply system 16 via ducting 18. Outside air intake 20 and return air duct 22 supply a mixture of fresh ventilation air and recirculated air, respectively, for conditioning by air supply system 16 prior to distribution. In a typical installation, a room air return duct (not shown) has its intake air end located in the room containing distribution unit 12 and connected to the return return air duct 22. Thus, the room air duct receives a portion of the air supplied by distribution unit 12 and routes it back to return air duct 22 through dampers 24 for further mixing and conditioning.

Outside air intake 20 provides a fixed, minimum source of fresh ventilation air for induction system 10 regulated by dampers 26. A plenum 28 mixes the outside air and return air received in central air supply system 16 and includes filters 30 for filtering the mixture of air prior to further conditioning. Existing induction system 10 is designed to provide air conditioned to 70° F. and, as such, dampers 24 and 26 are modulated to temper the ventilated mixture to 70° F. During cooler months, a central heating unit 32 is activated to heat the mixture of outside air and return air as required to provide the 70° F. conditioned air. A constant volume fan system 34, including a fan 36 driven from pulley 38 by a constant speed motor 40, pumps the 70° F. conditioned air through ducting 18 to a plurality of primary air ducts 14 for receipt by a corresponding plurality of distribution units 12.

Existing induction system 10 is of a design typically used in older schools in Indiana which, in the past, was not designed for mechanical cooling. Instead, because schools were not air conditioned, only minimum ventilation and heating of the air were provided and windows were opened to accommodate over-heated conditions. As such, the design of induction system 10 does not include provisions for mechanical or natural economizer cooling of air in school buildings. Many of today's schools, however, demand air conditioning to provide a proper learning and teaching environment for its occupants. In addition, schools with poor environmental conditions are not conducive in retaining the choice teachers. Because the original design does not include adequate future provisions for proper cooling, the existing induction systems, typified by existing induction system 10, are costly to upgrade.

As shown in FIGS. 1 and 2, distribution unit 12 includes an enclosure 42 having a discharge grill 44. An existing induction unit 46 receives conditioned 70° F. air from primary air duct 14. Induction unit 46 includes a slotted outlet 48 for accelerating the conditioned 70° F. air prior to discharge. As the air is accelerated, static pressure of the air is reduced to create a low pressure zone within distribution unit 12 adjacent induction unit 46. This low pressure zone induces recirculation air flow from space 50 into distribution unit 12 through opening 52. The recirculated air is mixed with the high velocity 70° F. air from induction unit 46 and discharged into space 50 through grill 44.

Given this induction scheme, distribution 12 is sensitive to deviations from the original design parameters and, as a result, is difficult to modify for cooling. For example, prior modifications have attempted to cool the recirculated air induced through opening 52. However, the cooled recirculation air, having a greater density than warm air, resists induction and tends to settle near the bottom of distribution 12 and not mix with the warmer air. Furthermore, distribution unit 12 is difficult to adjust to accommodate deviations from the original design parameters.

For example, in the above described cooling modification, greater amounts of higher velocity air are required to exit the induction unit 46 for proper induction of the cooled recirculation air and for proper temperature balance during mixing. Although distribution unit 12 includes manually adjustable dampers 47 for adjusting the amount of of air received by induction unit 46, the adjustment is by trial and error thus involving an iterative process. This iterative process is further compounded when considering a plurality of like distribution units 12, each requiring manual adjustments to accommodate the cooled recirculation air. Furthermore, the adjustment of each distribution unit 12, to supply greater or lesser amounts of air through dampers 47, affects the air supplied to other distribution units since fan system 34 pumps a fixed amount of conditioned air.

As a result, manual field adjustment of the dampers 47 is a time consuming and laborious process which, oftentimes, does not ultimately result in an optimally balanced air conditioning system. Therefore, fan system 34 is typically oversized to allow for proper system operation in a given application having inadequate field balancing. Furthermore, once field adjusted, system 10 operates as a fixed system which does not compensate for either environmental or system changes.

In FIGS. 1 and 2, distribution unit 12 also includes hot water finned Cube radiation 54 connected to plumbing fittings 51 and 53 for secondary heating of the mixed air prior to discharge from distribution unit 12. A thermostat 56 controls the flow of hot water through finned radiator 54 to maintain the temperature in space 50. Distribution unit 12 is designed to supply air to space 50 comprising 50% primary air conditioned to 70° F. and 50% recirculation air induced from space 50. As such, the temperature of the mixed air exiting distribution unit 12 is approximately the average of the 70° F. primary air and the temperature of the room air. If, for example, the room air is at 76° F., the air exiting distribution unit 12 is approximately 73° F.

As a practical matter, each room in a building does not have the same heat load. For example, in cold winter months, one room might be particularly drafty and/or adjacent one or more exterior walls, thus requiring additional heating by hot water finned radiator 54 to maintain the set space temperature. Conversely, another room might be an interior room partially occupied or a room fully occupied with an exterior wall having a southern exposure and comprised of glass windows, thus creating a high heat load from which little relief is available during warm spring or fall months.

Other problems as well exist with the current induction system 10. For example, because induction unit 46 includes a slotted outlet 48 for increasing the velocity of the discharged air, the conditioned air provided by primary air duct 14 must have sufficient air pressure to overcome this resistance thus requiring a larger fan 36. Additionally, for providing recirculation of air, fan 36 must be continuously run to provide the air flow necessary in induction unit 46 for inducing room air into distribution unit 12. As such and because of the high velocity of air exiting slotted outlet 48, turbulence discharge noise is constantly generated by the distribution unit. Also, the sound generated by the central air supply system 16 may be communicated by ducting 18 to the induction unit, as distribution unit 12 does not include adequate means for attenuating noise. As yet another example, modifications for filtering room air entering distribution unit 12 are difficult. Because filters increase the resistance which the induced room air entering the distribution unit must overcome, less recirculated air is induced thus altering the system balance and operational characteristics.

Taken alone, any one of the problems present in the typical induction system 10 can be compensated for by trading off some overall system efficiency. However, as additional modifications are made, overall system performance and efficiency are further reduced to a point where system operation becomes unacceptable. Therefore, the present invention provides a retrofit air conditioning system which improves the existing system's operational characteristics, including its sensitivity to deviations from a particular field adjusted design operating point, while retaining much of the existing hardware.

Figure 4:
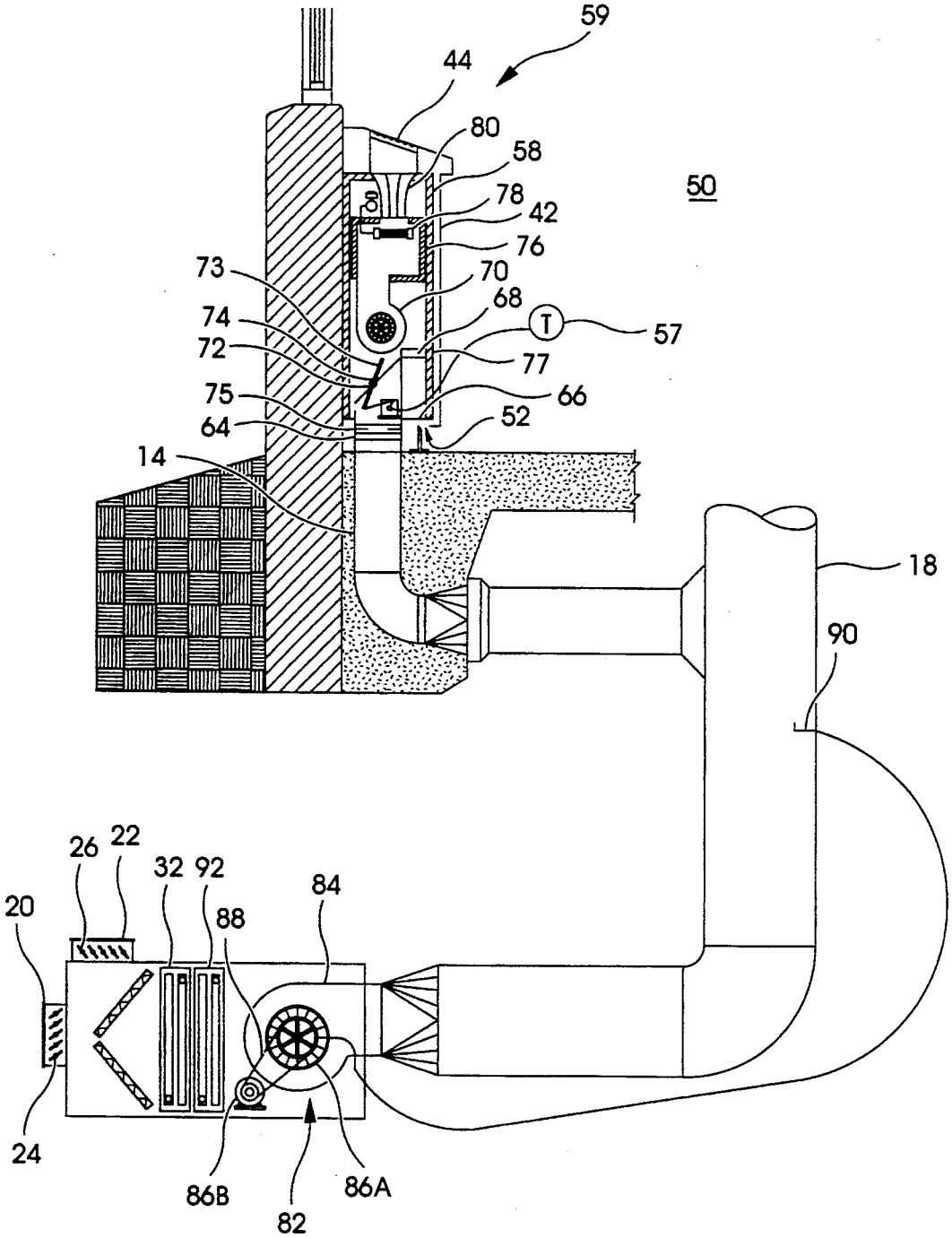
FIG. 4 is a side partial cross-sectional view of a retrofit air conditioning system according to another embodiment of the present invention.

Referring now to FIG. 4, a retrofit induction unit 58 of retrofit air conditioning system 59 is shown received in existing enclosure 42. Retrofit induction unit 58 replaces the existing induction unit 46 and finned radiator 54, wherein the retrofit induction unit connects to the same plumbing fittings 51 and 53 and connects with the same primary air duct 14. Retrofit induction unit 58 includes a primary air inlet 64 for receiving conditioned air from ducting 14 and connects to primary air duct 14 at the primary air inlet. Induction unit 58 also includes a recirculation air inlet 66 for receiving recirculated room air through opening 52. Recirculation air inlet 66 includes a filter 68 for filtering recirculated air received from space 50.

Induction unit 58 includes fan 70 for inducing air from space 50 into the distribution unit through recirculation air inlet 66. By incorporating local rather than central fan powered induction, induction unit 58 eliminates the system design sensitivity of the prior induction system 10. More specifically, and as is explained later, the distribution units of retrofit system 59 are no longer directly interdependent. Rather than depending on the central air supply system for providing the air flow necessary to induce room air into the distribution unit, induction unit 58 relies on fan 70 of each distribution unit. Because fan 70 induces conditioned air from primary air duct 14 as well, the air pressure required at primary air duct 14 and associated power required of fan system 34 is reduced over that of prior induction system 10. The central air supply system instead must only supply sufficient air flow to meet the collective needs of the distribution units.

To control the amount of primary air supplied to induction unit 58 via duct 14, induction unit 58 includes an adjustable damper 72. Damper 72 is infinitely adjustable between open and closed positions to precisely control the amount of primary conditioned air received into the induction unit from duct 14. In the preferred embodiment, damper 72 is constructed with damper blades 73 permanently attached to a shaft 74. Additionally, shaft 74 includes nylon fittings which eliminate the need for lubrication and assure quite operation.

Because retrofit induction unit 58 modulates the amount of primary air received through primary air duct 14, adjustable dampers 47 are replaced by a restriction orifice 75 to balance system 59 at maximum air flow conditions. Unlike the prior induction system adjustable dampers, restriction orifice 75 only limits system 59 by balancing the distribution unit air flow at maximum flow conditions. At less than maximum flow conditions, damper 72 is automatically adjusted to maintain a desired room temperature, thereby automatically compensating for changes in air pressure in duct 14. Orifice 75 is sized to maintain minimum air velocities and associated turbulence sound levels. In the preferred embodiment, orifice 75 is selected using a computer run duct design program. Preferably the duct design program is employed to select new ducting and confirm existing ducting using standard static regain design methodology.

Fan 70 exhausts into an acoustically lined discharge plenum 76 to further reduce turbulence noise generated by the high air velocities. Preferably, plenum 76 includes one inch thick dual density thermal/acoustical insulation which is surface treated to prevent erosion. Discharge plenum 76 includes a heating coil 78 for further heating the air as required prior to discharge. Heating coil 78, unlike hot water finned tube radiation 54 of the existing system 10, is an actual coil incorporating a serpentine construction which facilitates transfer of heat from the coil to the air to minimize the required flow of hot water. Other means for heating air are contemplated as well for induction unit 58 which match that provided by an existing heat source. For example, electrically heated coils or steam heated coils facilitate installation with an existing system having a ready source of electricity or steam.

A diffuser section 80, incorporating aerodynamic turning vanes for proper air distribution, provides a smooth transition to reduce the air velocity prior to discharge through grill 44. Diffuser section 80 may also include additional acoustical distribution baffles and perforated plates to ensure even air diffusion and distribution across the entire grill 44 of existing enclosure 42.

To further attenuate noise from the central fan system, retrofit induction unit 58 is insulated as well. Similar to discharge plenum 76, one inch thick dual density thermal/acoustical insulation 77 lines induction unit 58 to ensure quiet operation.

Retrofit induction unit 58 alone may be incorporated with an existing fan system 34 or, in the preferred embodiment, with a retrofit fan system 82. Fan system 82 includes a fan 84 connected with a variable volume vane controller 86A and a variable speed motor 86B by pulley 88. Fan system 82 is connected with a pressure sensor 90 and incorporates means for controlling the air volume by vane controller 86A or speed of motor 86B according to the sensed pressure to maintain a near constant pressure in ducts 14 and ducting 18. Because each retrofit induction unit 58 modulates the amount of air received therein, the overall air flow circuit is subject to continual downstream changes in resistance as the dampers 72 adjust. As a result, fan system 82 varies the air flow output of fan 84 by varying the vane controller 86A or speed of motor 86B to match the air flow required by the distribution units.

If retrofit induction unit 58 is used with an existing fan system 34, the air pressure in ducting 14 and 18 will change as the dampers modulate in the distribution units. As such, each distribution unit will directly impact the other distribution units. However, unlike an existing system such as system 10, the dampers 72 will continually adjust to accommodate changes in supply pressure caused by the modulating dampers of other distribution units. As such, changes in operating characteristics of the air conditioning system are automatically compensated for by the dampers, rather than requiring manual adjustment and field balancing of prior dampers 47. Although not the preferred embodiment, utilizing induction unit 58 with a constant volume fan system 34 is nevertheless both a cost and operational improvement over an existing system 10.

In FIG. 4, a cooling coil and chiller assembly 92 are provided upstream of the fan system 82 to cool the mixture of outside air and return air provided by outside air intake 20 and return air duct 22 as required to maintain a 55° F. supply temperature. Unlike existing system 10 which continually tempers the ventilated mixture to 70° F., system 59 is designed to provide a ventilated mixture at 55° F. As such, central heating unit 32 is normally not required during operation in winter months for providing heating of the introduced ventilation air since modulation of dampers 24 and 26 alone will maintain a supply of 55° F. ventilated air to the distribution units. During operation in warmer months, cooling assembly 92 is activated as required to cool the mixture of outside air and return air and maintain a conditioned supply of air at 55° F. for receipt by the distribution units.

The retrofit induction unit 58 modulates damper 72 to control the amount of 55° F. air supplied by primary air duct 14. The operation of heating coil 78 and adjustable damper 72 is controlled according to the temperature sensed in space 50 by a controller receiving inputs from a thermostat 94. An auxiliary cooling coil assembly, including associated diffuser plates, drain pan and valving, may also be incorporated in induction unit 58. Similar to heating coil 78, the auxiliary cooling coil assembly cools the mixture of conditioned air and recirculation air induced by fan 70 prior to discharge from the induction unit.

For example, during winter months when outside air temperatures are well below the desired or set point room temperature, cooling assembly 92 is not operational. Instead, dampers 24 and 26 are modulated to supply 55° F. primary ajar, and heating coil 78, not optional heating coil 32, heats the air as required to maintain the set point room temperature. During warmer summer months when outside air temperatures are, for example, well above 55° F., cooling assembly 92 is operational and provides cooled air at 55° F. to the distribution units. Heating coil 78 is typically not operational when cooling assembly 92 is operational since modulation of damper 72 is usually sufficient to maintain the set point room temperature. During other periods when outside air temperatures are, for example, just below 55° F., both cooling assembly 92 and heating coil 78 are not operational. Instead, in this economy mode, dampers 24 and 26 and damper 72 are modulated to provide the desired set point temperature, wherein varied open damper positions of both damper 72 and damper 24 ensure that adequate amounts of cool, fresh ventilation air are circulated to the individual rooms.

Figure 7:
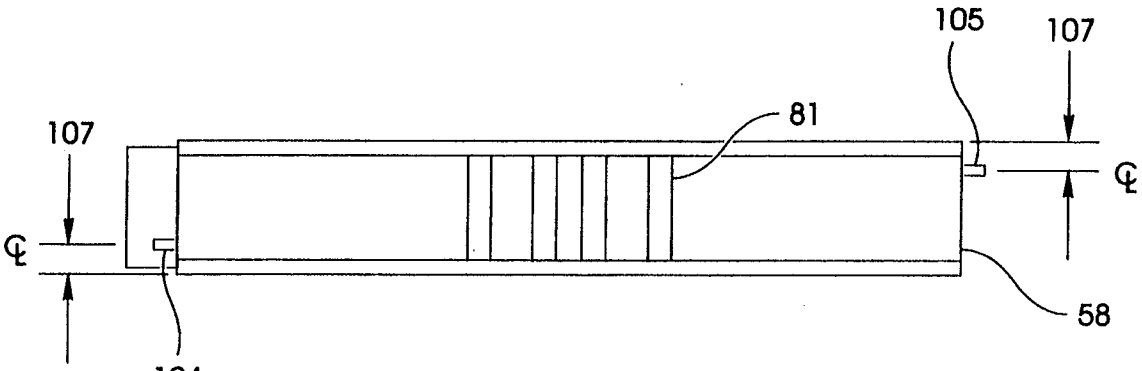
FIG. 7 is a top plan view of the retrofit induction air conditioning unit of FIG. 3.
Figure 5:
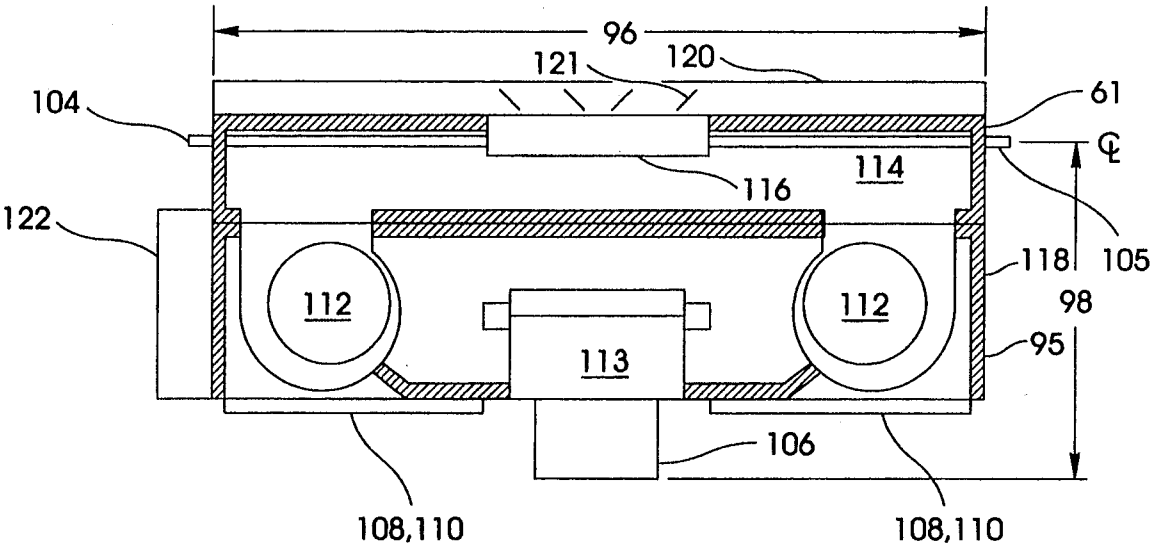
FIG. 5 is a front cross-sectional view of the retrofit induction air conditioning unit of FIG. 3.
Figure 6:
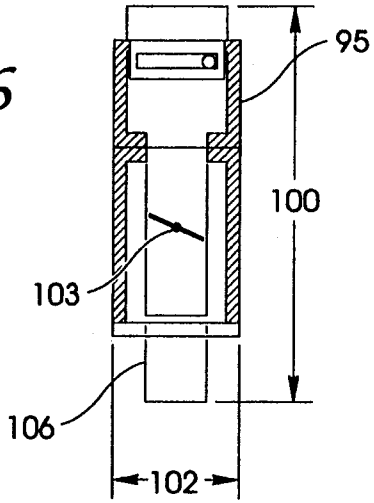
FIG. 6 is a side cross-sectional view of the retrofit induction air conditioning unit of FIG. 3.

Referring now to FIGS. 3 and 5–7, an alternate embodiment of a retrofit induction unit 95 is shown. Retrofit induction unit 95 is received in a distribution unit of an existing induction system designed by the E.I. Brown Company of Indianapolis, Ind., and is specifically sized to permit installation with minimal alteration of the existing system. For example, in FIG. 5 induction unit 95 has an overall length 96 of 60 inches (152.4 cm.) and a height 98 between plumbing fittings 104 and 105 and primary air inlet 106 of 25.125 inches (63.8 cm.). Referring now to FIG. 6, induction unit 95 has an overall height 100 of 29.5 inches (74.9 cm.) and an overall width 102 of 10 inches (25.4 cm.). Referring now to FIG. 7, plumbing fittings 104 and 105 are symmetrically located relative to front and rear faces of induction unit 95 at a distance 107 of 2.25 inches (5.7 cm.).

Figure 3:
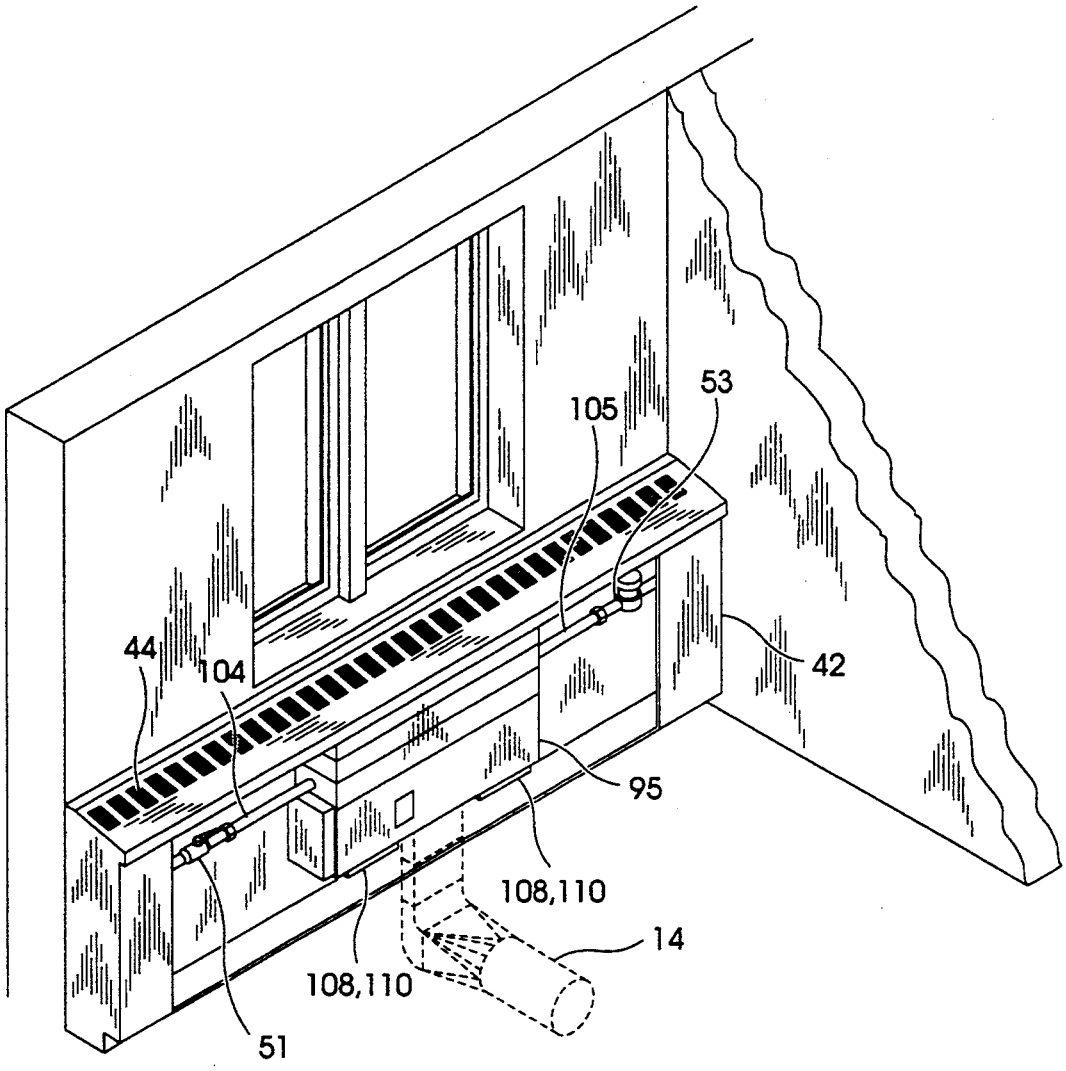
FIG. 3 is a perspective view of a retrofit induction air conditioning unit received in an existing distribution unit according to one embodiment of the present invention.

As is further shown in FIGS. 3 and 5, recirculation air induced from the room enters induction unit 95 through recirculation air inlets 108 having filters 110 thereacross. Fans 112 induce both recirculated air from the room and conditioned air through the damper of damper assembly 113 from primary air duct 14. Fans 112 are forward curved centrifugal type fans driven by a direct drive motor. Each motor is a permanent split capacitor type motor complete with infinitely adjustable solid state speed control to facilitate field balancing. To reduce operating noise characteristics, each fan and motor is suspended and isolated by rubber bushings from the induction unit.

Induction unit 95 and discharge plenum 114 include insulation 118 for attenuating noise transmitted by fans 112 and the fan system 82. Plenum 114 receives the output air from the fans and provides means for mixing the air prior to discharge through heating coil 116. Diffuser section 120 includes aerodynamic turning vanes 121 for distributing the air at minimum velocity external of induction unit 95. A controller box 122 housing a controller governs operation of induction unit 95.

Figure 8:
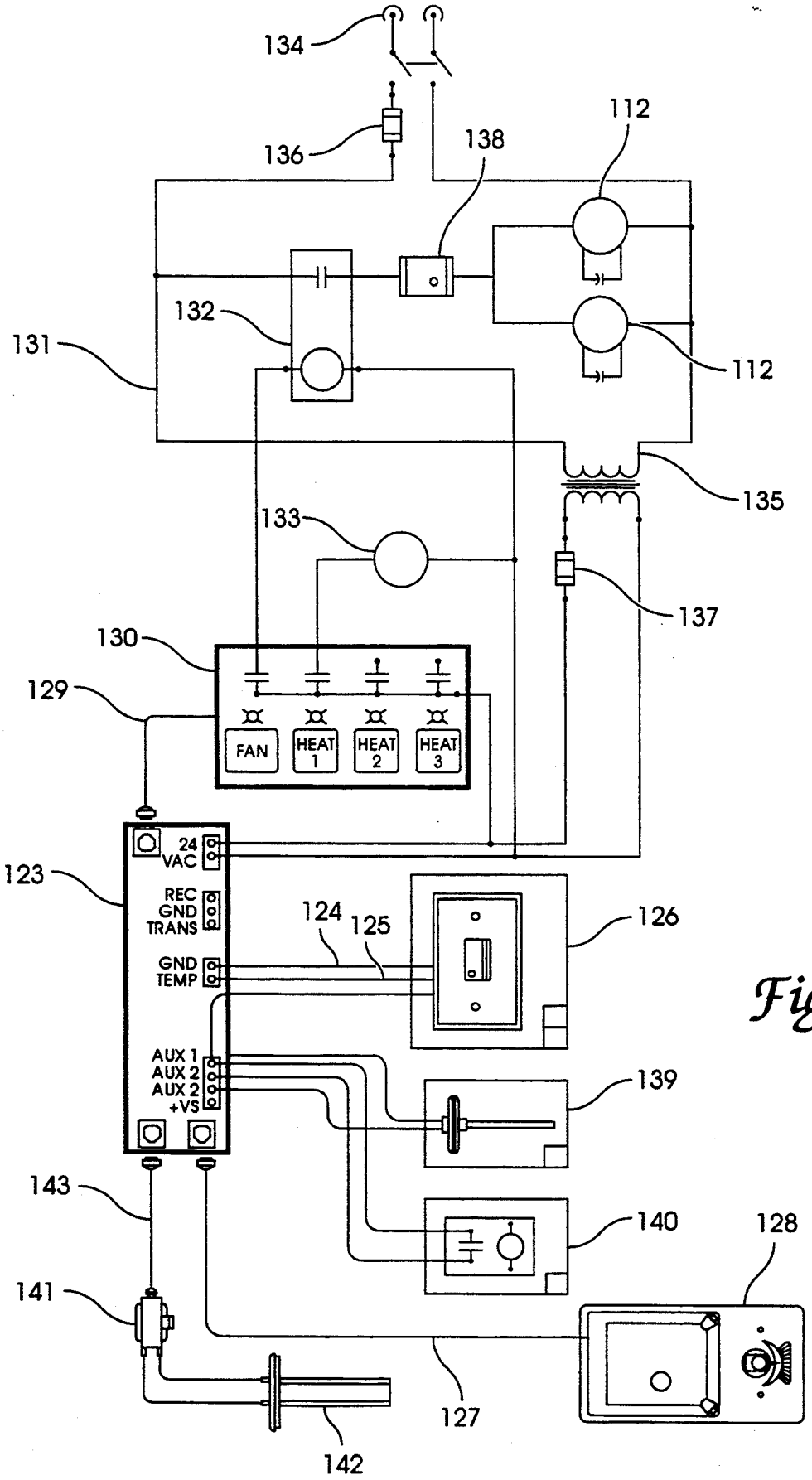
FIG. 8 is a diagrammatic illustration of components of the retrofit induction air conditioning unit of FIG. 3 electrically connected to a direct digital controller.
Figure 9:
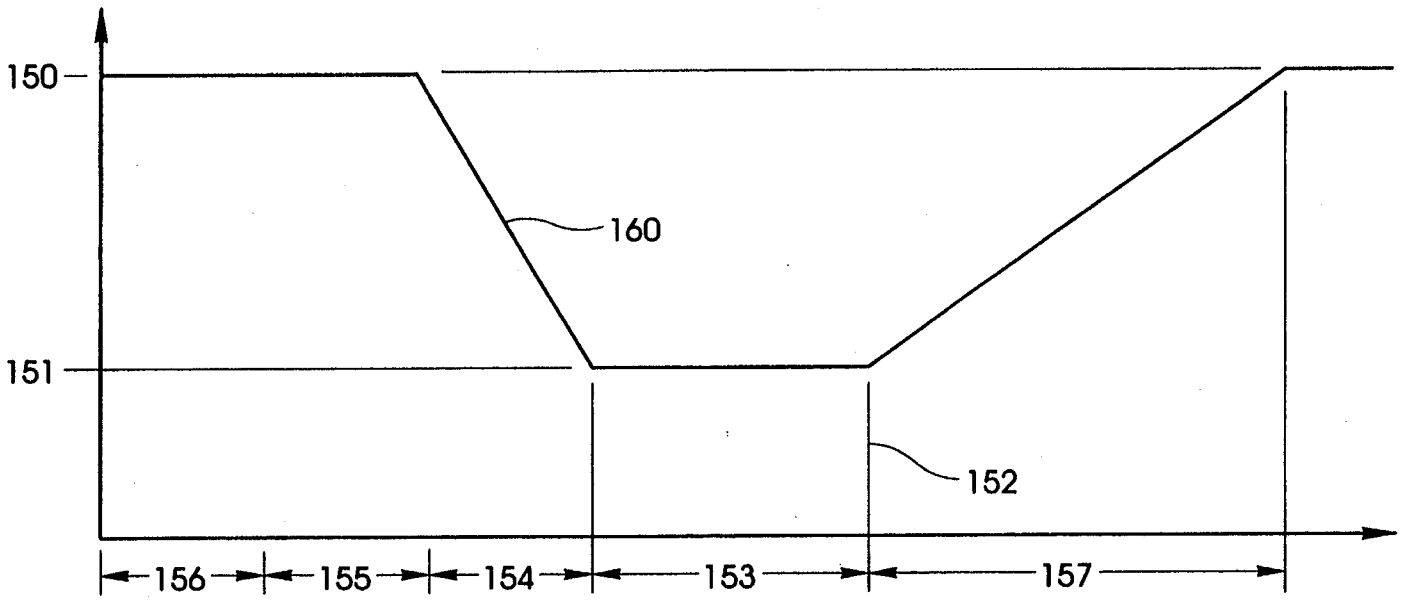
FIG. 9 is a graphical illustration of the air flow through the retrofit induction air conditioning unit of FIG. 3 varying according to space temperature.

Referring now to FIGS. 8 and 9, the control of the retrofit induction unit 95 is described in greater detail. A controller 123 housed within controller box 122 receives a temperature signal via conductors 124 and 125 from thermostat 126, wherein thermostat 126 includes means for adjustably setting a desired temperature and means for sensing temperature in the room. Thermostat 126 produces a temperature signal corresponding to the temperature differential between the desired or set point temperature and the sensed temperature. Controller 123 determines an appropriate damper signal according to the temperature signal and transmits the damper signal via line 127 to damper actuator 128. Damper actuator 128 provides means for adjusting the damper of damper assembly 113 to vary the amount of primary conditioned air entering induction unit 95.

Similarly, controller 123 also determines a fan signal and a heating signal according to the temperature signal and transmits these signals via line 129 to relay expansion board 130. Relay expansion board 130 provides connecting means for engaging a fan circuit 131 via fan relay 132 according to the fan signal and for engaging a heating valve actuator 133 according to the heating signal. Fan circuit 131 receives power through a power switch 134 and includes a control transformer 135 for stepping down the received power to 24 volts A.C. for energizing controller 123. Fuses 136 and 137 provide circuit overload protection for the fan circuit and controller, respectively. Fan circuit 131 also includes a speed controller 138 for adjusting the speeds of fans 112. Although controller 123 may also include means for adjusting fan speed according to the sensed room temperature, in the preferred embodiment speed controller 138 is field adjusted to provide a desired maximum air flow through induction unit 95. Once adjusted, fans 112 operate at a constant speed with air flow into induction unit 95 controlled by the damper of damper assembly 113.

In the preferred embodiment, controller 123 also includes input means for receiving an auxiliary temperature sensor 139, a day/night relay 140, and a velocity pressure transducer 141 and velocity pressure pickup 142. Temperature sensor 139 provides stand-alone controller operation independent of thermostat 126. Day/night relay 140 switches between occupied and unoccupied modes of operation preprogrammed in controller 123 to conserve energy. Pressure pickup 142 and pressure transducer 141 permit air flow to be measured for further controlling operation of the system. For example, with a retrofit fan system 82 controlling the air supply pressure in duct 14, damper position can be controlled only as a function of room temperature, but for more accurate operation, is controlled as a function of both room temperature and measured air flow. With induction unit 95 used in conjunction with an existing fan system 34, damper position is controlled as both a function of temperature and measured air flow.

Also in the preferred embodiment, controller 123 is a direct digital controller including a microprocessor having true external watchdog protection to ensure system reboot upon program interruption. To facilitate ease of connection, controller 123 includes prewired phone jack inputs for receiving corresponding phone jack connectors 127, 129, and 143.

A variety of operational modes may be preprogrammed in controller 123 to improve the system's operational characteristics. For example, on initial power-up a calibration routine is performed. In the calibration routine, the actuator positions the damper to its full clockwise mechanical stop and then back to its full counterclockwise mechanical stop in order to determine the maximum possible damper travel and to recalibrate the air flow sensor. Controller 123 switches between an occupied mode and unoccupied mode of operation via day/night relay 140. In the occupied mode, both "proportional" and "proportional plus integral" modes of operation are available. Operationally, as the space temperature rises above the cooling set point, the actuator 128 modulates the damper of damper assembly 113 to increase the air flow from minimum to maximum air flow. In the "proportional" mode, the actuator 128 controls the air flow to a value proportional with the temperature differential between the sensed temperature and the set point temperature. When the space temperature rises to 4.0° F. above the set point temperature, the damper is maintained open to provide maximum air flow.

As space temperature drops below the set point temperature, a first stage of heat is energized. When the first stage of heat is energized, actuator 128 repositions the damper of damper assembly 113 to provide maximum air flow. As the space temperature continues to drop, two additional stages of heat are turned on in 1.0° F. intervals.

In the "proportional plus integral" mode, the air flow control value is slowly reset to eliminate system overshoots and hunting about the set point temperature. In the cooling mode, when the space temperature is above the set point temperature, the integral action causes the damper to continue to open gradually towards a damper position to provide the desired air flow. As the space temperature drops below the set point temperature, the first stage of heat is energized. When the first stage of heat is energized, actuator 128 gradually repositions the damper of damper assembly 113 towards a damper position which provides the desired air flow. In the "proportional plus integral" mode, the integral constant is adjustable from 0.0 to 9.9. The higher the constant, the more the potential for hunting. The lower the constant, the longer it takes to compensate for changes in temperature.

Referring now to FIG. 9, the operation of controller 123 is described in greater detail. Maximum air flow through the damper is represented by line 150 and minimum air flow through the damper is represented by line 151. A desired temperature set point is represented by line 152, wherein temperature differentials of particular temperatures deviating from the desired set point are represented by heating ranges 153 through 156 and a cooling range 157. Heating range 153 is a heat offset which provides hysteresis to prevent continuous cycling of heating coil 116 at room temperatures at or near the desired set point. Typically, a hysteresis of 1.0° F. to 2.0° F. is adequate, wherein the preferred embodiment employs a hysteresis of 1.5° F. Heating range 154 is approximately 0.5° F., and heating ranges 155 and 156 are each approximately 1.0° F. Cooling range 157 is approximately 4.0° F.

The controller varies the damper position with temperature and, therefore, varies the primary air flow into induction unit 95 with temperature according to curve 160. For example, for a set point of 76° F., if the room temperature is between 74.5° F. and 76° F. no heat is provided and the damper is adjusted to provide the minimum air flow. If the room temperature is between 74° F. and 74.5° F., a first heating signal is transmitted to heating valve actuator 133. In response to the first heating signal, actuator 133 controls the flow of hot water into heating coil 116 to a first flow level corresponding to a first heating level. Concurrently, the damper is adjusted to provide the maximum air flow.

If the room temperature is between 73° F. and 74° F., the damper is maintained to provide the maximum air flow level and a second heating signal is transmitted to heating valve actuator 133. In response to the second heating signal, actuator 133 controls tile flow of hot water into heating coil 116 to a second flow level corresponding to a second heating level. If the room temperature is less than 73° F., the damper is maintained to provide the maximum air flow level and a third heating signal is transmitted to heating valve actuator 133. In response to the third heating signal, actuator 133 controls the flow of hot water into heating coil 116 to a third flow level corresponding to a third heating level.

If the room temperature is between 76° F. and 80° F., the damper is modulated linearly with temperature between positions providing the minimum and maximum air flow levels. Above 80° F., the damper is maintained to provide the maximum air flow level.

In the unoccupied mode, controller 123 applies additional hysteresis, including additional heating and cooling offsets, to reduce system cycling and conserve energy. Other modes are preprogrammed into the controller as well. For example, a force mode is provided which permits overriding of the set damper position to force the damper of damper assembly 113 into a fully open or fully closed position. A warm-up mode is provided for use with a system 59 incorporating a central heating unit 32, wherein heating by heating coils 116 is locked out and the dampers are forced to their full open position to provide fast warm-up.

Also, the controller can include preprogrammed heating and cooling set points which override the thermostat set point during peak demand periods. The controller can also allow its hysteresis offsets to be input manually by the user to override the preprogrammed offsets. Auxiliary relays can be provided as well to drive other systems associated with the room environment such as room lighting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A retrofit air conditioning system for use with an existing induction air conditioning system, the existing system including a distribution unit in a room, the distribution unit including a heating unit and an induction unit contained within an enclosure, said retrofit air conditioning system comprising:

a retrofit induction unit sized for receipt in the existing distribution unit, said retrofit induction unit being received in the existing enclosure and replacing the existing heating and induction units;

said retrofit induction unit further comprising means for receiving conditioned air from a duct, means for adjusting the amount of conditioned air received from the duct in response to a first signal, means for receiving recirculated air from the room, fan means for inducing conditioned air from the duct and inducing recirculated air from the room, said fan means exhausting a mixture of conditioned air and recirculated air, and means for heating the mixture of conditioned air and recirculated air in response to a second signal;

means disposed downstream from said fan means for diffusing said mixture of conditioned air and recirculated air, said diffusing means receiving said mixture at a first velocity and further exhausting said mixture at a reduced second velocity;

means for sensing temperature in the room and producing a temperature signal; and controller means for receiving the temperature signal and producing the first signal and the second signal in accordance with the sensed temperature.

2. The retrofit air conditioning system of claim 1, and further comprising:

central fan means for supplying conditioned air to the duct at a first predetermined temperature;

wherein said central fan means includes means for cooling the supply of conditioned air to the first predetermined temperature.

3. The retrofit air conditioning system of claim 2, wherein said central fan means includes means for varying the supply of conditioned air.

4. The retrofit air conditioning system of claim 3, and further comprising:

means for sensing the flow of conditioned air received by said retrofit induction unit from the duct and producing an air flow signal;

wherein said controller means includes means for receiving the air flow signal and producing a third signal in accordance with the sensed air flow.

5. The retrofit air conditioning system of claim 4, wherein said means for varying includes responding to the third signal to maintain a near constant pressure in the duct.

6. The retrofit air conditioning system of claim 5, wherein said central fan means includes means for heating the supply of conditioned air to a second predetermined temperature.

7. A retrofit air conditioning unit for receipt in an existing distribution unit of a room, comprising:

a housing sized for receipt in the distribution unit;

a primary air inlet for receiving conditioned air from a conditioned air source into said housing;

an adjustable damper disposed across said primary air inlet;

means for adjusting said adjustable damper in response to a first damper signal;

a recirculated air inlet for receiving recirculated air from the room into said housing;

a fan disposed in said housing downstream of said adjustable damper and said recirculated air inlet, said fan inducing conditioned air through said adjustable damper and inducing recirculated air through said recirculated air inlet, said fan exhausting a mixture of conditioned air and recirculated air;

means for sensing temperature in the room and producing a temperature signal;

means for heating the mixture of conditioned air and recirculated air, said heating means being responsive to a plurality of heating signals to provide a corresponding plurality of heating levels; and controller means for receiving the temperature signal and producing the first damper signal and the plurality of heating signals in accordance with the sensed temperature.

8. The retrofit air conditioning unit of claim 7, and further comprising:

a fan discharge plenum disposed downstream of said fan and receiving the mixture of conditioned air and recirculated air exhausted from said fan;

said fan discharge plenum being acoustically insulated to reduce noise transmitted to the room; and said fan discharge plenum including said heating means, said fan discharge plenum exhausting the mixture of conditioned air and recirculated air through said heating means.

9. A retrofit air conditioning unit for receipt in an existing distribution unit of a room, comprising:

a housing sized for receipt in the distribution unit;

a primary air inlet for receiving conditioned air from a conditioned air source into said housing;

an adjustable damper disposed across said primary air inlet;

means for adjusting said adjustable damper in response to a first damper signal;

a recirculated air inlet for receiving recirculated air from the room into said housing;

a fan disposed in said housing downstream of said adjustable damper and said recirculated air inlet, said fan inducing conditioned air through said adjustable damper and inducing recirculated air through said recirculated air inlet, said fan exhausting a mixture of conditioned air and recirculated air;

means for sensing temperature in the room and producing a temperature signal;

controller means for receiving the temperature signal and producing the first damper signal in accordance with the sensed temperature;

means for heating the mixture of conditioned air and recirculated air in response to any of a plurality of heating signals;

wherein said controller means includes means for producing the heating signals in accordance with the sensed temperature;

a fan discharge plenum disposed downstream of said fan and receiving the mixture of conditioned air and recirculated air exhausted from said fan;

said fan discharge plenum being acoustically insulated to reduce noise transmitted to the room;

said fan discharge plenum including said heating means, said fan discharge plenum exhausting the mixture of conditioned air and recirculated air through said heating means; and an expansion nozzle disposed downstream of said fan discharge plenum;

wherein said expansion nozzle receives the mixture of conditioned air and recirculated air exhausted from said fan discharge plenum at a first velocity and exhausts the mixture at a reduced second velocity.

10. The retrofit air conditioning unit of claim 9, and further comprising:

means for sensing the flow of conditioned air received by said primary air inlet and producing an air flow signal;

wherein said controller means includes means for receiving said air flow signal and producing a second damper signal in accordance with the sensed air flow.

11. The retrofit air conditioning unit of claim 10, wherein:

said temperature sensing means is a thermostat which produces a temperature signal corresponding to a temperature differential between the sensed temperature and a set point temperature; and said controller means is a direct digital controller including a microprocessor.

12. The retrofit air conditioning unit of claim 11, wherein:

said heating means includes a heating coil and a heating valve actuator; and said heating valve actuator controls the flow of hot water through said heating coil to provide a first heating level in response to a first heating signal, a second heating level in response to a second heating signal, and a third heating level in response to a third heating signal.

13. The retrofit air conditioning unit of claim 12, wherein:

said adjusting means includes a damper actuator for adjusting said damper to vary the amount of primary conditioned air entering through said primary inlet in response to the first damper signal.

14. The retrofit air conditioning unit of claim 13, wherein:

said direct digital controller produces the first heating signal corresponding to the first heating level and the first damper signal when the sensed temperature is below a first predetermined temperature;

said direct digital controller produces the second heating signal corresponding to the second heating level and the first damper signal when the sensed temperature is below a second predetermined temperature; and said direct digital controller produces the third heating signal corresponding to the third heating level and the first damper signal when the sensed temperature is below a third predetermined temperature.

15. The retrofit air conditioning unit of claim 14, wherein said direct digital controller produces the first damper signal when the sensed temperature is above a fourth predetermined temperature.

16. The retrofit air conditioning unit of claim 15, wherein said damper actuator adjusts said damper to vary the amount of primary conditioned air entering through said primary inlet in response to the second damper signal.

17. The retrofit air conditioning unit of claim 16, wherein said recirculated air inlet includes a filter for filtering recirculated air induced from the room.

18. The retrofit air conditioning unit of claim 17, wherein said primary air inlet includes a restriction orifice for restricting the amount of conditioned air induced therein.

19. The retrofit air conditioning unit of claim 18, wherein said housing is acoustically insulated to reduce noise transmitted to the room.

20. An air conditioning system for supplying conditioned air to a room, comprising:

a housing;

means for receiving conditioned air into said housing;

means for adjusting the amount of conditioned air received into said housing in response to a first signal;

means for receiving recirculated air from the room;

fan means for inducing the conditioned air into said housing and the recirculated air from the room, said fan means exhausting a mixture of conditioned air and recirculated air;

means for sensing temperature in the room and producing a temperature signal;

controller means for receiving the temperature signal and producing a first signal in accordance with the sensed temperature;

means for heating the mixture of conditioned air and recirculated air in response to a second signal;

wherein said controller means includes means for producing a second signal in accordance with the sensed temperature; and means for cooling the mixture of conditioned air and recirculated air in response to a third signal;

wherein said controller means includes means for producing a third signal in accordance with the sensed temperature.

21. A retrofit air conditioning system for use with an existing induction air conditioning system of a building having a plurality of rooms, the existing system including an existing central fan system supplying conditioned air through existing ducting of the building to a plurality of existing distribution units corresponding to the plurality of rooms, wherein each distribution unit includes an existing heating unit receiving heat from an existing heat source and an existing induction unit receiving conditioned air from the existing ducting, the heating unit and induction unit being contained within an existing enclosure, said retrofit air conditioning system comprising:

a retrofit induction unit sized for receipt in an existing distribution unit, said retrofit induction unit being received in the existing enclosure and replacing the existing heating and induction units, and said retrofit induction unit receiving heat from the existing heat source;

said retrofit induction unit further comprising means for receiving the conditioned air from the existing ducting of the building, means for adjusting the amount of conditioned air received from the existing ducting in response to a first signal, means for receiving recirculated air from the room, fan means for inducing conditioned air from the existing ducting and inducing recirculated air from the room, said fan means exhausting a mixture of conditioned air and recirculated air, and means for receiving heat from the existing heat source and heating the mixture of conditioned air and recirculated air in response to a second signal;

means disposed downstream from said fan means for diffusing said mixture of conditioned air and recirculated air, said diffusing means receiving said mixture at a first velocity and further exhausting said mixture at a reduced second velocity;

means for sensing temperature in the room and producing a temperature signal;

means for sensing the flow of conditioned air from the existing ducting into the retrofit induction unit and producing an air flow signal; and controller means for receiving the temperature signal and air flow signal and producing the first signal and the second signal in accordance with the sensed air flow and temperature.

* * * * *